US006546647B2

(12) United States Patent
Speck

(10) Patent No.: US 6,546,647 B2
(45) Date of Patent: Apr. 15, 2003

(54) METHOD AND APPLIANCE FOR THE NON-THERMAL DRYING OF MOTOR VEHICLE BODIES, FRESHLY PAINTED WITH A WATER-BASED PAINT

(75) Inventor: Hans-Joachim Speck, Boeblingen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/885,444

(22) Filed: Jun. 21, 2001

(65) Prior Publication Data

US 2002/0038521 A1 Apr. 4, 2002

(30) Foreign Application Priority Data

Jun. 21, 2000 (DE) ..... 100 30 383

(51) Int. Cl.[7] ..... F26B 3/00

(52) U.S. Cl. ..... 34/468; 34/548; 34/78; 34/219; 34/666

(58) Field of Search ..... 34/468, 528, 548, 34/557, 77, 78, 219, 666

(56) References Cited

U.S. PATENT DOCUMENTS

| | | | | |
|---|---|---|---|---|
| 3,831,294 A | * | 8/1974 | Freze | 34/131 |
| 4,785,552 A | * | 11/1988 | Best | 34/418 |
| 4,907,533 A | * | 3/1990 | Nelson et al. | 118/663 |
| 5,361,511 A | | 11/1994 | Brown | 34/468 |
| 5,661,912 A | * | 9/1997 | Bhatnager et al. | 24/267 |

FOREIGN PATENT DOCUMENTS

| | | | | |
|---|---|---|---|---|
| DE | 3637737 | | 6/1989 | |
| DE | 4228698 | * | 6/1993 | |
| DE | 29504040 | | 5/1996 | |
| DE | 19644717 | | 4/1998 | |
| DE | 19781220 | | 4/2000 | |
| FR | 1025426 | | 4/1953 | |
| JP | 04358556 A | * | 12/1992 | 34/666 |
| WO | 95/08745 | | 3/1995 | |

OTHER PUBLICATIONS

Copy of Search Report.

* cited by examiner

*Primary Examiner*—Ira S. Lazarus
*Assistant Examiner*—Kathryn S. O'Malley
(74) *Attorney, Agent, or Firm*—Crowell & Moring LLP

(57) ABSTRACT

A method and an appliance are disclosed for the non-thermal drying of articles, in particular motor vehicle bodies, freshly painted with a water-based paint. The articles to be dried are subjected to dry air by forced convection in a drying tunnel and the moisture-laden air is dried in an air drying device by condensation to a specific target value of absolute residual moisture. So that fluctuations in the incidence of moisture can be leveled out with a low degree of inertia, with the high condensation performance remaining unchanged, only a fraction of the circulated air which is adapted in size, as required, is dried in the air drying device to a residual moisture markedly below the circulating-air target moisture, and the remaining untreated part of the circulated air is led back into the drier housing after being intermixed with the dried part-air stream.

40 Claims, 2 Drawing Sheets

METHOD AND APPLIANCE FOR THE NON-THERMAL DRYING OF MOTOR VEHICLE BODIES, FRESHLY PAINTED WITH A WATER-BASED PAINT

BACKGROUND AND SUMMARY OF THE INVENTION

This application claims the priority of German Patent Application No. 100 30 383.8, filed Jun. 21, 2000, the disclosure of which is expressly incorporated by reference herein.

The invention proceeds from a method and an appliance for the non-thermal drying of articles, in particular motor vehicle bodies, freshly painted with a water-based paint, in which the articles to be dried are introduced into a drier housing, the surfaces of the articles are subjected to dry air in the drier housing by forced convection and, after the paintwork has dried, the articles are discharged from the drier housing, after the air has passed through the drier housing, after the air has passed through the drier housing the moisture-laden air being sucked away from the drier housing, the moisture contained being extracted from said air in an air drying device by condensation and the air thus being dried to a predetermined circulating-air target moisture and being blown into the drier housing again. The method also relates to an appliance for carrying and the method. German Patent Document DE 196 44 717 A1 describes a method and appliance of this general type Articles, in particular vehicle bodies, painted as standard are painted in a plurality of coats, usually water-based paints being employed at least for the priming and the top-up painting for reasons of environmental protection. However, these paints cannot be applied wet-on-wet, but, instead, before each subsequent application of a further coat of paint, the coat of water-based paint previously applied has to be dried to specific maximum permissible residual moisture of about 5 to 10% by weight. During the subsequent thermal stove-enamelling of the entire composite structure of the paints, higher residual moisture would result in the paint bursting open, because the quantity of water vapor released from the residual moisture cannot defuse through the composite structure quickly enough.

The intermediate drying of the individual coats, particularly of water-based paints, has hitherto been carried out thermally in a drying tunnel, in which the paint on the vehicle bodies is heated by hot circulating air and/or by radiant-heat emitters and the water contained in it is thus evaporated carefully. The moisture-laden spent air is extracted as a whole from the drying process, if appropriate after a recovery of heat. This is a highly energy-intensive drying operation, especially since not only the drying air, but also the vehicle bodies, have to be continuously first heated to high temperature values and then cooled again.

A less energy-intensive drying method, at least for water-based paints, has therefore been considered, this being described in principle in the publication mentioned in the introduction. This proposal is correct in its approach. A problem which it does not solve arises from a different incidence of moisture on the freshly painted articles. In everyday production, the freshly painted articles are not introduced into the paint drying plant in a time sequence which is always constant, but, instead, it is necessary, in this respect, to allow for a change, for example with interruptions of greater or lesser length or with a recommencement of production.

An object of the invention is to improve the generic method and the corresponding generic appliance to the effect that, even in the event of a different and, above all, rapidly changing incidence of moisture on the painted articles, these can always be dried to a specific target residual moisture and a constant dwell time of the painted articles in the paint drying plant can be nevertheless maintained. Exceeding the target residual moisture in the dried paint, that is to say insufficient drying of the paint, causes the paint to burst open during the subsequent stove-enamelling, thus resulting in time-intensive and cost-intensive additional work and serious logistical problems. On the other hand, the paintwork should not be overdried, because this is unfavorable for a good binding of the coat of paint subsequently applies. Apart from this, overdrying would also be uneconomic in terms of energy and cost. Moreover, a varying dwell time of the painted articles in the paint drying plant cannot be allowed for logistical reasons.

Taking the generic method and the generic appliance as a basis, the object mentioned is achieved according to the invention by a method, wherein the drying performance of the air drying device is adapted as required with a low degree of inertia to a changing infeed of moisture into the drier housing, and wherein with the high condensation performance remaining unchanged, only a fraction of the circulated air which is adapted in size as required, is dried in the air drying device to a residual moisture below the circulating-air target moisture, and the remaining untreated part of the circulated air is led back into the drier housing after being intermixed with the dried part-air stream.

This object is further achieved by providing an appliance wherein a bypass line is provided which branches off from the spent-air stream upstream of the suction blower and bypasses the air drying device and conducts untreated air to the supply-air blower, wherein the suction blower is provided with a variable-speed drive and conveys only a variable fraction of circulated air through the air drying device which amounts to a maximum of about 60% by volume of the total circulated air, wherein the air drying device is dimensioned and designed in such a way that in the case of a maximum loading of the spent air with moisture and with maximum load being applied to the air drying device, the air treated in the latter can be dried to a markedly lower value, preferably half the value, of the circulating-air target moisture, wherein the bypass line and the line emerging at the air drying device and carrying the dried air are combined upstream of the supply-air blower, wherein a controller is provided which processes measurement data from a moisture sensor located on the supply-air side and/or those from a moisture sensor located on the spent-air side and by means of which the conveying capacity of the suction blower can be varied automatically via the rotational drive speed of the latter, in such a way that the desired circulating-air target moisture can be maintained on the supply-air side.

A rapid adaptation of the drying performance of the plant to the changing incidence of moisture is important for reliably maintaining the target residual moisture at least within a permissible tolerance range. According to the invention, rapid adaptation is achieved on the air side by a variation in a dried part-air stream and an untreated part-air stream. In the case of a high incidence of moisture on the painted articles, the operation is carried out with a high dried air fraction; the untreated circulating-air fraction is correspondingly lower. In the case of a low incidence of moisture, the situation is reversed; then, the dried air fraction is reduced in favor of the untreated circulating-air fraction. The air drying device is designed, in terms of its drying performance, in such a way that, even in the case of the maximum dried part-air stream required, the circulating-air target moisture can still be maintained reliably. With the reduced fraction of air to be dried, although the air is overdried, as compared with the abovementioned state, due to the installed drier capacity, this is not harmful because of the intermixing with the untreated fraction; in any event, the desired circulating-air target moisture can be maintained for a short time. Overdrying of the dried air can readily be justified on energy grounds, because the energy balance, even in the case of an overdried fraction, is not appreciably different from that occurring in the design situation. It is merely necessary for a corresponding capacity of a drying performance to be installed once.

Expedient refinements of the invention may be gathered from this description and the claims. Morever, the invention is also explained below with reference to an exemplary embodiment illustrated in the drawings.

Other objects, advantages and novel features of the present invention will become apparent from the following detailed description of the invention when considered in conjunction with the accompanying drawings.

DETAILED DESCRIPTION OF THE DRAWINGS

Figure 1:
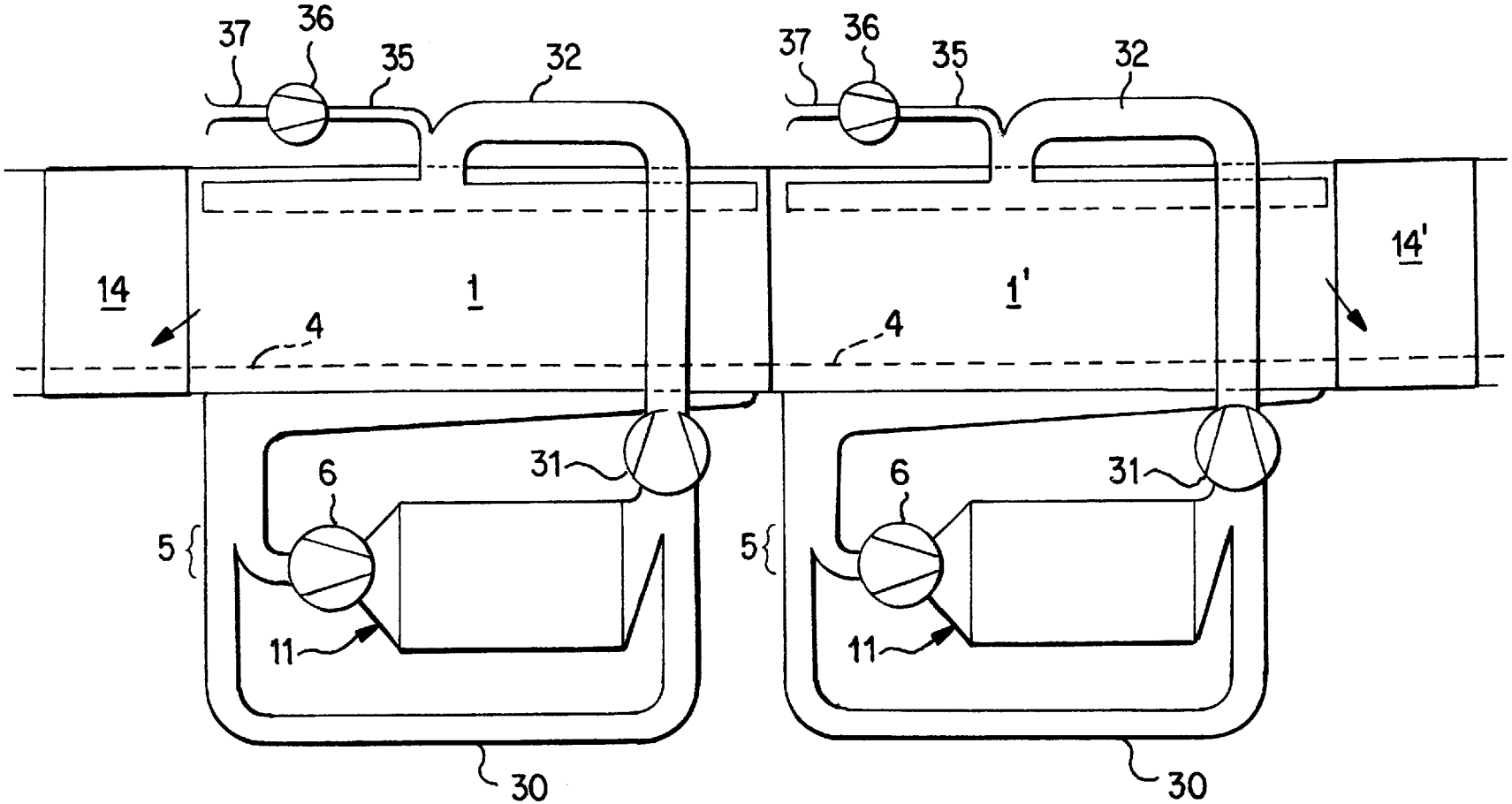
FIG. 1 shows a diagrammatically illustrated exemplary embodiment of a tunnel drying plant for the no-thermal two-stage drying of a water-based paint freshly applied to motor vehicle bodies.

The figures show a process plant for the non-thermal drying of articles freshly painted with a water-based paint, for example, of motor vehicle bodies 2 mounted on body carriers 3 which are themselves conveyed at a constant conveying speed through a drying tunnel 1,1' on the air-permeable bottom 4. The exemplary embodiment illustrated relates to a two-stage drying tunnel with two tunnel sections 1 and 1' of a first and of a second drying stage, said tunnel sections adjoining one another, but being capable of being partitioned off from one another. A lock chamber 14 and 14', likewise capable of being partitioned off, is provided in each case upstream and downstream of the tunnel sections of the two drying stages. The tunnel sections may be partitioned off from one another and from the lock chambers by lifting gates or by transversely movable sliding gates.

Figure 2:
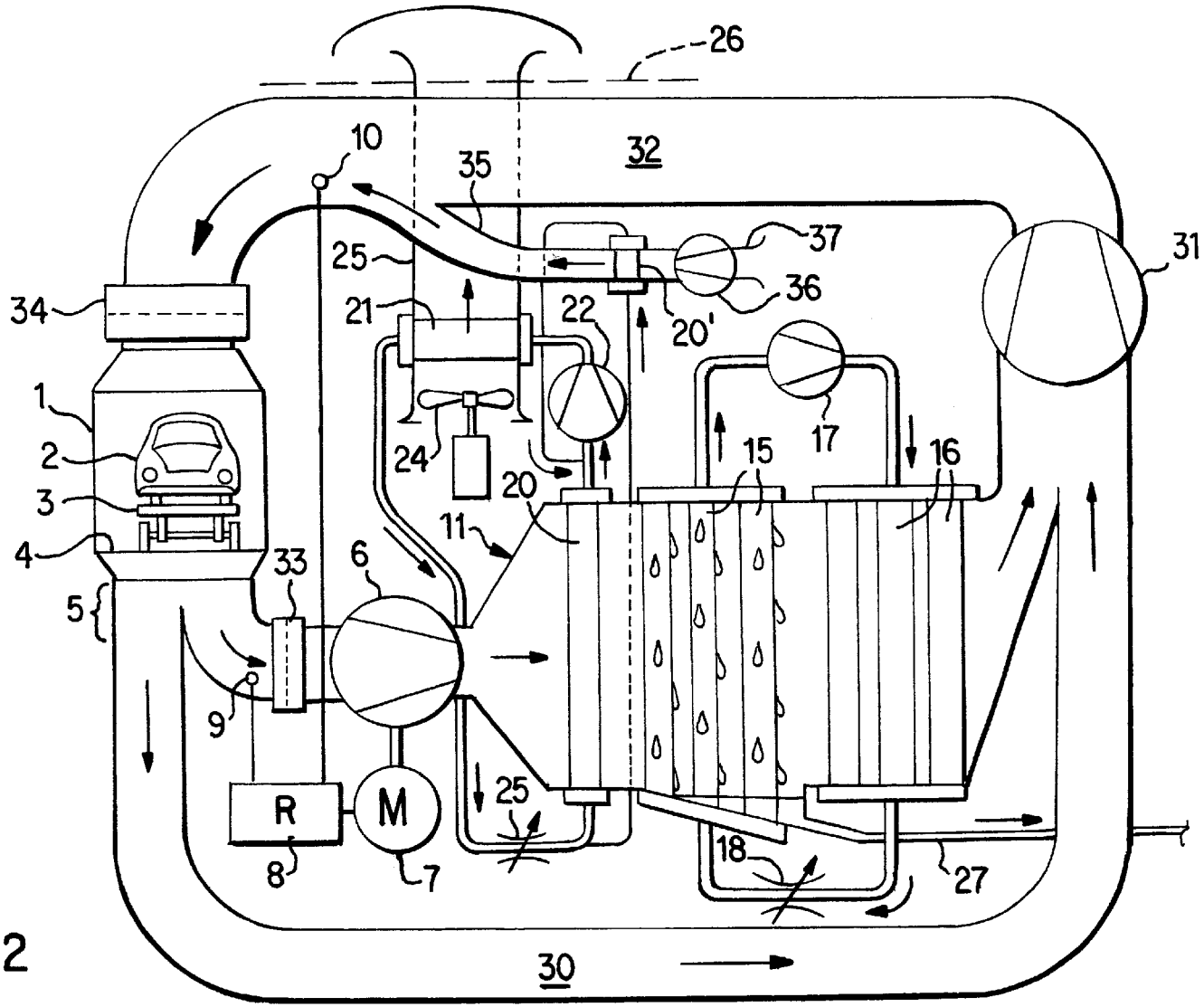
FIG. 2 shows the air drying device of the plant according to FIG. 1 in a more detailed illustration and with associated peripherals.

The paint drying plant illustrated contains, for non-thermal drying, an air drying device 11, to which the moisture-laden air is supplied from the drying tunnel via a spent-air line and a suction blower 6. The air drying device contains a cold trap 15 (FIG. 2), at which the moisture is extracted from the air by condensation. The dried air may be led back into the drying tunnel by a supply-air blower 31 via a supply-air line 32.

The bodies to be dried are lock-transferred into the drying tunnel at one end, the surfaces of the articles are subjected therein to dry air by forced convection and, after the drying of the paintwork, the bodies are lock-transferred out of the drying tunnel. After the air has passed through the drying tunnel, the moisture-laden air is sucked away from the latter, the moisture contained is extracted from the air in the air drying device 11 by condensation and the air is dried to a specific target value of absolute residual moisture, referred to below as the "circulating-air target moisture", and is blown into the drying tunnel again.

The paint applied to the vehicle bodies is to be dried to a specific and always constant target residual moisture by virtue of the drying process or in the drying plant. However, a varying and sometimes even rapidly changing incidence of moisture is to be expected on the painted vehicle bodies on account of the varying loading density in the drying tunnel. A varying dwell time of the painted vehicle bodies in the drying tunnel cannot be allowed for logistical reasons.

So that the changing incidence of moisture in the air drying device can be levelled out with a low degree of inertia, a series of measures are provided according to the invention. A bypass line 30 branches off from the spent-air stream at the branch pint 5, that is to say even upstream of the suction blower 6, said bypass line bypasses the air drying device 11 and therefore conducts air, untreated, to the supply-air blower 31. The suction blower 6, accordingly, conveys through the air drying device 11 and therefore conducts air, untreated, to the supply-air blower 31. The suction blower 6, accordingly, conveys through the air drying device 11 only a fraction of the total circulated air which amounts to a maximum of about 60% by volume of the total circulated air. Due to a variable-speed drive 7 of the suction blower, this fraction varies rapidly. The air drying device is dimensioned and designed such that, in the event of a maximum loading of the spent air with moisture and maximum load applied to the air drying device, the air treated in the latter can be dried to a markedly lower value, preferably half the value of the circulating-air target moisture. The untreated air flowing through the bypass line and the dried air emerging at the air drying device are recombined upstream of the supply-air blower, so that the dried air and the untreated air are mixed in the supply-air blower and are delivered jointly to the drying tunnel again.

By means of a moisture sensor 10 located on the supply-air side and a moisture sensor 9 located on the spent-air side, moisture data of the circulated air are detected at the respective points and these measurement data are processed in a controller 8. The controller automatically varies the rotational drive speed of the suction blower or its conveying capacity, in such a way that the desired circulating-air target moisture can be maintained on the supply-air side.

By virtue of this refinement of the paint drying plant, with the high condensation performance in the air drying device 11 remaining unchanged, the dried part-air stream is dried to a residual moisture below the circulating-air target moisture and the remaining untreated part of the circulated air is led back into the drier housing after being intermixed with the dried part-air stream. As a result, rapid adaptation of the drying performance of the plant to the changing incidence of moisture is possible, and the circulating-air target moisture can be maintained reliably at least within a permissible tolerance range. The absolute circulating-air target moisture is between 3.0 and 5.0 g of water per kg of moist air, preferably about 4±0.2 g/kg.

When freshly painted vehicle bodies are introduced into the drying tunnel in an uninterrupted sequence, the incidence of moisture on the painted articles is very high and may be considered to the maximum. The fraction of air to be dried is then increased to a high maximum fraction—see further below for more details relating to this design criterion—of the total circulated air quantity; the untreated circulating-air fraction is correspondingly lower. In the case of a low incidence of moisture, the situation is reversed; then, the dried air fraction is reduced in favor of the untreated circulating-air fraction. The drying device is designed, in terms of its drying performance, in such a way that, even in the case of a maximum dried part-air stream required, the circulating-air target moisture in the total circulated air in the inflow into the drying tunnel (moisture measuring sensor 10) can still be maintained reliably. By contrast, if, because of interruptions or disturbances in the previous body painting, a large number of locations in the drying tunnel are unoccupied and only a small amount of moisture is introduced into the drying tunnel, the air fraction to be dried is reduced in favor of the untreated air fraction, for example to about 25 to 30% by volume, although the total circulated air quantity per unit time is kept constant.

The performance of the cold circuit of the cold trap acting by condensation is also continued at a constantly high level, irrespective of the fluctuations in the incidence of moisture. In the case of a reduced fraction of air to be dried, although the air is overdried, as compared with a state with a high air fraction to be dried, because of the installed drier capacity, this is not only harmless on account of the intermixing with the untreated fraction of the circulated air, but, in any event, the desired circulating-air target moisture can be maintained for a short time. Overdrying of the dried air cannot only be readily justified on energy grounds, but, because of the intermixing with the moister untreated air, is even necessary in order to maintain the desired circulating-air target moisture. It is necessary merely for a corresponding capacity of a drying performance to be installed.

How high the maximum required fraction of air to be dried is set in an operating state with a maximum incidence of moisture depends on the respective design of the paint drying plant. When a very high condensation performance is installed in the air drying device and therefore the air treated in the latter is dried out to a very great extent, then, in the case of a very high moisture infeed into the paint drying plant, the air drying device needs to be operated only with a relatively low maximum fraction of, for example, 40% by volume of dry air, with respect to the total circulated air quantity. By contrast, in the case of a relatively low condensation performance, the air treated in the air drying device is dried to a lesser extent, then, in the case of a high moisture infeed, the fraction of dry air must amount, for example, to 60%. When the air treated in the air drying device is dried to an extent such that, as compared with the circulating-air target moisture, it contains about half the quantity of moisture per unit of air quantity, then, in the case of a moisture infeed into the paint drying plant which is assumed to be maximum, the fraction of dried air will amount to about 50% of the total circulated air quantity. In the case of a reduced infeed of moisture into the paint drying plant, the fraction of dried air is reduced correspondingly, and, on account of the constantly high condensation performance, the residual moisture of the dried air is lower, that is to say the treated air is then dried to a greater extent. In any event, by the dried air being intermixed with the untreated air fraction, the desired circulating-air target moisture is maintained in the total circulated air on the supply-air side.

It is conceivable, in principle, to vary the fraction of the air to be dried in various ways, for example by means of deflecting flaps which change the inlet cross section with the bypass line 30 in favor of or at the expense of the inlet cross section into the air drying device. The air fraction to be dried may also be varied by a variation in the conveying capacity of this blower. There are, basically, various possibilities for this, too, for example by the adjustment of the angle of incidence of the conveying blades or by a variation in the rotational drive speed of the conveying blower 6. It is also conceivable to vary indirectly the circulating-air fraction to be dried, in that the untreated uncirculating-air fraction is influenced directly by measures of the above-mentioned type.

The air drying device 11 is, in principle, a duct of preferably rectangular cross-sectional shape which is greatly widened in the flow cross section and in which a plurality of heat exchangers are arranged. By virtue of the increased flow cross section, the air flows through the air drying device relatively slowly, so that good heat exchange occurs in the latter. In the front part of the air drying device, the air-loaded heat exchanger surfaces 20 and 15 are cooling surfaces, whereas, in the rear part, the air is heated again via heat exchanger surface 16.

To generate the necessary low temperatures on the cooling surfaces—the temperature of the moist air must fall markedly below the dew point—, various refrigerant circuits, which lead through said heat exchangers, are provided in the paint drying plant.

In this connection, a main cooling circuit must be mentioned first, which consists of a refrigerant compressor 17, of a plurality of refrigerant condensers 16 which are arranged parallel to and next to one another and through which the refrigerant flows, of a throttle 16 and of a further set of heat exchangers, to be precise the refrigerant evaporators 15 which constitute a cold trap. In order to achieve sufficiently low temperature in the air and on the heat exchanger surfaces, a series of precoolers 10 is also arranged in the air drying device upstream of the refrigerant evaporators 15 in the air flow direction, said precoolers likewise functioning as refrigerant evaporators and therefore being part of another refrigerant circuit, to be precise a secondary cooling circuit. The main components of this secondary refrigerant circuit are likewise a refrigerant compressor 22, a plurality of refrigerant condensers 21 arranged next to one another in a waste-heat air line 25, a throttle 23 and the refrigerant evaporators 20 already mentioned, located in the air drying device at the front. For the refrigerant, there is, in parallel in terms of flow, a further refrigerant evaporator 20' which is arranged in an excess-air line 35, dealt with in more detail further below, and which cools the excess air conveyed in it.

The air flowing into the air drying device is precooled by the refrigerant evaporators 20 of the secondary cooling circuit. The extracted heat is discharged, via the refrigerant condensers 21 arranged in the waste-heat air line 25, to uninvolved workshop air which is conveyed by means of the cooling blower 24 through the refrigerant condensers and through the waste-heat air line and finally into the open via the workshop roof 26.

When the air enters the series of refrigerant evaporators 15 of the main cooling circuit, it is already precooled to temperature near freezing point by virtue of the action of the secondary cooling circuit. The refrigerant of the main cooling circuit has in the refrigerant evaporators a temperature of −10 to −20° C., depending on the intensity with which the air drying device is subjected to air. A higher temperature is established in the case of a high air throughout than in the case of a lower air throughout. In any event, regardless of the air throughout through the air drying device, the cooling circuits are operated with an approximately constant performance. By virtue of the low temperature of the evaporator surface, the moisture contained in the air is precipitated there by condensation and settles on the surfaces of the heat exchanger fins. The condensate liquid which collects on the surface and is enriched agglomerates into larger drops which, as a consequence of gravity, run off along the smooth-faced heat exchanger fins downwards into a collecting trough and can be discharged from the latter via the condensate line 27. In the case of a maximum throughput of air to be dried, the absolute residual moisture of the air dried in this way is, depending on the design of the air drying device and of the paint drying plant as a whole, around a value in the range of between 1.5 and 2.5 g/kg, preferably about 2±0.1 g/kg.

The air thus dehumidified is first still very cold. It is led, in the air drying device, through the series of heat exchangers of the refrigerant condensers 16 of the main cooling circuit, in the interior of which condenses the refrigerant led through, compressed, but still in vapor form, is condensed and at the outside of which the air flowing around is heated to about room temperature. The relative atmospheric moisture is thereby lowered and its ability to absorb moisture is increased.

Since the freshly applied water-based paint initially discharges its moisture in the drying tunnel more easily to the air flowing around than when the paintwork has already dried somewhat, the continuously operated paint drying plant illustrated in FIG. 1, with a drying tunnel, provides two successive drying stages with air-separated air drying devices 11. In the exemplary embodiment illustrated, the drying stages succeeding one another within the drying tunnel are designed with a length approximately equal to one another, with the result that approximately equal circulating-air target moisture, for example the value of 4±0.2 k/kg already mentioned, is maintained for both stages. However, the two drying stages differ in the a aeration intensity. In the first drying stage, the painted articles are subjected to dried air by forced convection carefully, that is to say at a lower speed than in the second drying stage, for example at about 2 to 5 m/s, preferably about 3 m/s. In the second drying stage, the air impinges onto the already dried and hardened paint at about three times the outlet speed, preferably about 10 to 12 m/s. By virtue of the greater flow intensity of the dry air in the second stage, as compared with the first, improved conditions for a transition of moisture from the paint to the air are afforded.

An excess-air line 35 issues into the supply-air line 32 leading to the drying tunnel. Said excess-air line is connected to an excess blower 36 which sucks in air from the surrounds of the air drying device via a suction connection piece 37. As a result, when the paint drying plant provided with a drying tunnel is operated continuously, a slight overpressure in relation to the ambient-air pressure is constantly generated in the drying tunnel, thus preventing an uncontrolled ingress of air from adjacent treatment zones in the drying zone of the drying tunnel. With respect to the total circulated air quantity, a fraction of about 1 to 8% by volume, preferably about 3% by volume, of ambient air is continuously added to the total air recirculated into the drying tunnel. The excess air can flow over into the lock chambers 14, 14' and emerge from there into the workshop surroundings. Due to the size of the workshop and to the fact that it is heated or is ventilated in a controlled manner, the workshop air undergoes only very slight fluctuations in temperature and moisture. By the continuous addition of excess air, the air circulated in the paint drying plant is at the same time renewed continuously, albeit slowly. There are therefore no enrichments of solvent vapors or the like.

Owing to the constant and intensive swirling of the circulated air in high-performance blowers with moderate efficiency, an appreciable amount of power is continuously fed into the air and causes the air to be heated. The air would therefore soon tend to be heated to inappropriately high temperatures. In order to stabilize the circulated air permanently at a lower temperature level in the range of about 25 to 35° C., the added excess air is likewise utilized for this purpose, in that, before being added to the circulating air, it is cooled to about 5 to 15° C., preferably to about 10° C., for cooling the excess air fed in, the het exchanger already mentioned, to be precise a further refrigerant evaporator 20' of the secondary cooling circuit, is arranged in the excess-air line 35.

Since new air is constantly fed into the air circuit from the workshop air which may also contain dust particles, in order to protect the paintwork against the accretion of dust the total recirculated air is filtered before it enters the drying tunnel. For this purpose, an air filter 34 is arranged in the supply-air line 32 leading to the drying tunnel.

Dust particles may also be entrained out of the drying tunnel into the drying process and into the circulated air and may settle on the partially wet heat exchange surfaces of the air drying device 11 and impair heat exchange. To prevent this, the fraction of the circulated air which is to be dried is also filtered before it enters the air drying device. An air filter 33 is accordingly likewise arranged in the spent-air line feeding in the air drying device.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method for the non-thermal drying of motor vehicle bodies, freshly painted with a water-based paint, in which the articles to be dried are introduced into a drier housing, the surfaces of the articles are subjected to dry air in the drier housing by forced convection and, after the paintwork has dried, the articles are discharged from the drier housing, after the air has passed through the drier housing the moisture-laden air being sucked away from the drier housing, the moisture contained being extracted from said air in an air drying device by condensation and the air thus being dried to a predetermined circulating-air target moisture and being blown into the drier housing again, wherein the drying performance of the air drying device (11) is adapted as required with a low degree of inertia to a changing infeed of moisture into the drier housing (1,1'), and wherein with the high condensation performance remaining unchanged, only a fraction of the circulated air which is adapted in size as required, is dried in the air drying device (11) to a residual moisture below the circulating-air target moisture, and the remaining untreated part of the circulated air is led back into the drier housing (1,1') after being intermixed with the dried part-air stream.

2. Method according to claim 1, wherein in an operating state with a maximum incidence of moisture and, correspondingly, in the case of a maximum required fraction of air to be dried, the condensation performance of the air drying device (11) nevertheless being kept constant by not being increased, the residual moisture of the dried air being about 40 to 60%, preferably about 50%, of the circulating-air target moisture, and wherein in the case of lower required fractions of air to be dried, the residual moisture of the dried air is below this value and the treated air is then dried to a greater extent.

3. Method according to claim 1, wherein the variable fraction of air to be dried is set by a variation in the conveying capacity of a corresponding conveying blower(6) as a function of rotational speed.

4. Method according to claim 1, wherein in the state of a maximum required fraction of air to be dried, the air-loaded surfaces of a cold trap (15) are maintained at a temperature, constant in the static state, in the range of −10 to −20° C. and, in the case of lower fractions of air to be dried, are below this temperature.

5. Method according to claim 1, wherein the circulating-air target moisture is in the range of between 3.0 and 5.0 g of water per kg of moist air, preferably amounts to about 4±0.2 g/kg, and wherein in the case of a maximum required fraction of air to be dried, the residual moisture of the dried air of the treated part-quantity stream is in the range of between 1.5 and 2.5 g/kg, preferably about 2±0.1 g/kg.

6. Method according to claim 1, wherein the dried air of the treated part-quantity stream is intermixed with the air of the untreated part-quantity stream by a conveying blower (31) jointly conveying the two part-quantity streams, before the supply air is fed into the drier housing (1,1').

7. Method according to claim 1, wherein in the case of drying plants operated continuously by being fed at one end and, after the articles have passed through the drier housing designed as a drying tunnel (1,1'), emptied at the other end, the articles (2) are dried in at least two successive drying stages by air-separated air drying devices (11).

8. Method according to claim 7, wherein an approximately equal circulating-air target moisture is maintained for both stages.

9. Method according to claim 8, wherein the painted articles (2) are loaded in the first drying stage with an outlet speed of the dried air of about 2 to 5 m/s, preferably about 3 m/s, and in the second drying stage with about 3 times the outlet speed, preferably about 10 to 12 m/s.

10. Method according to claim 7, wherein an approximately equal dwell time of the articles (2) to be dried is maintained in both stages.

11. Method according to claim 7, wherein the painted articles (2) are loaded with the dried air by a forced convection at a lower speed in the first drying stage than in the second drying stage.

12. Method according to claim 1, wherein the fraction of circulated air to be dried is filtered (spent-air filter 33) before it enters the air drying device(11) and the total recirculated air is likewise filtered (supply-air filter 34) before it enters the drying housing.

13. Method according to claim 1, wherein in the case of drying plants operated continuously by being fed at one end and, after the articles have passed through the drier housing designed as a drying tunnel (1,1'), emptied at the other end, an excess of air is added continuously on the supply-air side, as compared with the air extracted on the spent-air side, as a result of an addition of ambient air to the air recirculating to the drying tunnel (1,1'), thus preventing an uncontrolled ingress of air from adjacent treatment zones into the drying zone of the drying tunnel (1,1'), and, furthermore, the air circulated in the latter at the same time is renewed continuously, albeit slowly.

14. Method according to claim 13, wherein a fraction of about 1 to 8% by volume, with respect to the total circulated air quantity, preferably about 3% by volume, of ambient air is continuously added to the air recirculated into the drying tunnel (1,1').

15. Method according to claim 13, wherein the ambient air, before being added to the circulating air, is cooled (evaporator 20') to about 5 to 15° C., preferably to about 10° C.

16. Appliance for the non-thermal drying of a water-based paint freshly applied to motor vehicle bodies, comprising:

a drier housing with a drying tunnel temporarily receiving the freshly painted articles, a spent-air line which discharges moisture-laden air from the drier housing and supplies it to an air drying device which contains a suction blower, said air drying device containing a cold trap for extracting the moisture from the circulating air by condensation and which dries the air to a specific circulating-air target moisture, and a supply-air line leading the dried air back into the drier housing and containing a supply-air blower, wherein a bypass line (30) is provided which branches off from the spent-air stream upstream of the suction blower (6) and bypasses the air drying device (11) and conducts untreated air to the supply-air blower (31), wherein the suction blower (6) is provided with a variable-speed drive (7) and conveys only a variable fraction of circulated air through the air drying device (11) which amounts to a maximum of about 60% by volume of the total circulated air, wherein the air drying device (11) is dimensioned and designed in such a way that in the case of a maximum loading of the spent air with moisture and with maximum load being applied to the air drying device (11), the air treated in the latter can be dried to a markedly lower value, preferably half the value, of the circulating-air target moisture, wherein the bypass line (30) and the line emerging at the air drying device (11) and carrying the dried air are combined upstream of the supply-air blower (31), wherein a controller (8) is provided which processes measurement data from a moisture sensor (10) located on the supply-air side and/or those from a moisture sensor (9) located on the spent-air side and by means of which the conveying capacity of the suction blower (6) can be varied automatically via the rotational drive speed of the latter, in such a way that the desired circulating-air target moisture can be maintained on the supply-air side.

17. Appliance according to claim 16, wherein in the case of a continuously operated drier housing designed as a drying tunnel (1,1'), at least two successive drying stages with air-separated air drying devices (11) are provided.

18. Appliance according to claim 17, wherein the drying stages succeeding one another with the drying tunnel (1,1') are designed with a length approximately identical to one another.

19. Appliance according to claim 17, wherein an excess-air line (35) issues into the supply-air line (32) leading to the drying tunnel (1,1'), said excess-air line being connected to an excess blower (36) sucking in ambient air from the surroundings of the air drying device (11).

20. Appliance according to claim 16, wherein an air filter (33) is arranged in the spent-air line leading to the air drying device (11).

21. Appliance according to claim 16, wherein an air filter (34) is arranged in the supply-air line (32) leading to the drier housing (1,1').

22. Appliance according to claim 16, wherein a heat exchanger (20') is arranged in the excess-air line (35) for cooling the excess air flowing in the latter.

23. A method of non-thermal drying of freshly painted vehicle bodies comprising:

placing the vehicle bodies in a drier housing, subjecting surfaces of the vehicle bodies to dry air in said drier housing, removing moisture laden air from the drier housing and separating the same into first and second moisture laden air portions, extracting moisture from the first portion to reduce moisture content of said first portion to below a circulating air target moisture level, mixing the first portion with the second portion to form a mixture with said circulating air target moisture level, and recirculating s aid mixture as drying air to said drier housing.

24. A method according to claim 23, wherein said drier housing is a drying tunnel through which vehicle bodies are conveyed.

25. A method according to claim 23, wherein said extracting moisture from said first portion includes drying said first portion in an air drying device with extraction of moisture by condensation.

26. A method according to claim 23, wherein said air drying device is operable to reduce the moisture content of the first portion to between 40% and 60% of the circulating air target moisture level.

27. A method according to claim 26, wherein said circulating air target moisture level is between 3 and 5 grams of water per kilogram of moist air.

28. A method according to claim 23, wherein said circulating air target moisture level is between 3 and 5 grams of water per kilogram of moist air.

29. A method according to claim 27, wherein the first portion is dried to a moisture level of between 1.5 and 2.5 grams of water per kilogram of moist air.

30. A method according to claim 23, wherein the drier housing is part of a continuously operative drying plant with first and second successive drying stages which each are supplied by recirculated air.

31. A method according to claim 30, wherein the painted articles are loaded with the dried air by a forced convection at a lower speed in the first drying stage than in the second drying stage.

32. Apparatus for non-thermal drying of freshly painted vehicle bodies, comprising:

a drier housing for the vehicle bodies, convection air supply means operable to supply drying air to the housing, removing means for removing moisture laden air from the drier housing and separating the same into first and second moisture laden air portions, extracting means for extracting moisture from the first portion to reduce moisture content of said first portion to below a circulating air target moisture level, mixing means for mixing the first portion with the second portion to form a mixture with said circulating air target moisture level, and recirculating means for recirculating said mixture as drying air to said drier housing.

33. Apparatus according to claim 32, wherein said drier housing is a drying tunnel through which vehicle bodies are conveyed.

34. Apparatus according to claim 32, wherein said extracting moisture from said first portion includes drying said first portion to an air drying device with extraction of moisture by condensation.

35. Apparatus according to claim 32, wherein said air drying device is operable to reduce the moisture content of the first portion to between 40% and 60% of the circulating air target moisture level.

36. Apparatus according to claim 32, wherein said circulating air target moisture level is between 3 and 5 grams of water per kilogram of moist air.

37. Apparatus according to claim 36, wherein the first portion is dried to a moisture level of between 1.5 and 2.5 grams of water per kilogram of moist air.

38. Apparatus according to claim 32, wherein the first portion is dried to a moisture level of between 3 and 5 grams of water per kilogram of moist air.

39. Apparatus according to claim 32, wherein the drier housing is part of a continuously operative drying plant with first and second successive drying stages which each are supplied by recirculated air.

40. Apparatus according to claim 39, wherein the painted articles are loaded with the dried air by a forced convection at a lower speed in the first drying stage than in the second drying stage.

* * * * *